US005402536A

United States Patent [19]

Matthews

[11] Patent Number: 5,402,536

[45] Date of Patent: Apr. 4, 1995

[54] FOREARM PROTECTOR FOR MEDICAL, DENTAL AND OTHER HEALTH CARE WORKERS

[76] Inventor: Joseph D. Matthews, 515½ Delaware, Leavenworth, Kans. 66049

[21] Appl. No.: 954,507

[22] Filed: Sep. 29, 1992

[51] Int. Cl.[6] ..... A41D 13/08

[52] U.S. Cl. ..... 2/16; 2/59; 2/161.7; 2/167

[58] Field of Search ..... 2/16, 59, DIG. 7, 161.7, 2/167, 168, 170, 46, 49.4, 51, 60, 162, 169

[56] References Cited

U.S. PATENT DOCUMENTS

| | | | |
|---|---|---|---|
| 3,256,882 | 6/1966 | Huber | 2/16 |
| 3,657,741 | 4/1972 | Blanco | 2/59 |
| 4,344,999 | 8/1982 | Gohlke | 2/DIG. 7 |
| 4,843,645 | 7/1989 | White | 2/59 |
| 4,856,112 | 8/1989 | Effle | 2/56 |
| 4,884,297 | 12/1989 | Triche | 2/16 |
| 4,918,754 | 4/1990 | Leatherman et al. | 2/16 |
| 4,967,419 | 11/1990 | Elliott | 2/16 |
| 5,063,919 | 11/1991 | Silverberg | 2/16 |
| 5,070,541 | 12/1991 | Goss | 2/16 |

FOREIGN PATENT DOCUMENTS

| | | | |
|---|---|---|---|
| 2135444 | 12/1972 | France | 2/16 |
| 2242805 | 3/1973 | Germany | 2/16 |
| 8802550 | 5/1990 | Netherlands | 2/16 |
| 287546 | 5/1928 | United Kingdom | 2/59 |
| 423045 | 1/1935 | United Kingdom | 2/59 |
| 8103265 | 11/1981 | WIPO | 2/DIG. 7 |
| 8900385 | 1/1989 | WIPO | 2/16 |

OTHER PUBLICATIONS

"New Inner Skin", *Modern Plastics,* American Anode, Nov. 1953, p. 63.

*Primary Examiner*—Clifford D. Crowder
*Assistant Examiner*—Amy B. Vanatta
*Attorney, Agent, or Firm*—Bruce J. Clark

[57] ABSTRACT

A forearm and skin protector worn over the hand and forearm to be used underneath standard rubber surgical gloves. The protector is a crushable, lightweight, semi-rigid material encompassing the palm and back of the hand and the forearm, and having openings for the thumb and at least two openings for the remaining four fingers, said material having an interior side nearest the skin and an exterior side opposite thereto, said interior side comprised of a moisture absorbing material, and the exterior side comprised of a cellophane-thin non-penetrable membrane.

4 Claims, 7 Drawing Sheets

FOREARM PROTECTOR FOR MEDICAL, DENTAL AND OTHER HEALTH CARE WORKERS

BACKGROUND OF INVENTION

The present invention relates to an inexpensive sanitary forearm protector for use with surgical gloves in the dental and medical field and for health care workers in general.

A clean and distinct hygienic barrier between doctor and patient, or in the laboratory, is necessary in all health care fields. The prevention of transmission of body fluids and germs in these conditions retards the spread of all diseases. Sanitary gloves normally available and used in the medical and dental fields are currently comprised of thin but strong rubber material and are relatively inexpensive. These gloves are purchased and used in large numbers and are found in nearly every dental and/or medical office.

However, the gloves protect only the hand and lower wrist. Even if they were extended to attempt to cover the forearm, they would not only be uncomfortably snug allowing no breathing space for the entire arm and hand, but the forearm portion would also tend to slide or roll back down the arm during use. The material of which they are comprised has also been known to cause allergic reactions to the sensitive back of the hand; moreover in many, and in fact in most, situations requiring the use of these gloves, hygienic protection is often needed for the forearm, particularly in those situations where short sleeves are worn. It is quite common for blood and the like to find its way onto the forearms of a dentist or physician while working on a patient, thus inviting infection, spread of disease, and general uncleanliness. Moreover, moisture buildup can also occur in the palm of the hand caused by perspiration and inability to breathe through the tight fitting glove.

It is important that any forearm protection stay in place on the forearm without tendency to collapse down to the wrist or slide up the forearm, that it be inexpensive, that it be of one size universally adaptable to use with surgical hand gloves commercially available and that it be disposable. It is further important that the forearm protection be extremely light, non-bulky, and that it not interfere or impede the movement of the fingers, hand and arm. It must be relatively cool when worn, allowing for the skin to breathe, particularly given the tight fitting nature of the surgical glove on the hand.

The current invention then provides a semi-rigid but light-weight forearm protector to be worn partially under standard surgical gloves. It is comprised of a light and thin semi-rigid material having non-penetrable and absorption capability which, in combination, opens the space in the palm of the hand for breathing and at the same time absorbs the moisture, to avoid moisture buildup in the hand.

Consequently it is an object of the invention to provide an inexpensive disposable sleeve and forearm protector to be used with standard rubber surgical gloves and that is semi-rigid to assure that it stays in place on the forearm during use.

It is also an object of the invention to provide such a protector while maintaining principally the same utility and dexterity as provided by surgical gloves alone, that is light-weight, and that helps prevent moisture buildup in the palm of the hand when in use.

Other objects and features of the invention and objectives and the manner in which the invention achieves its purpose will be appreciated from the foregoing and the following description and the accompanying drawings which exemplify the invention, it being understood that changes may be made in the specific invention disclosed herein without departing from the essentials of the invention set forth in the appended claims.

BRIEF SUMMARY OF THE INVENTION

The present invention is a thin, light, self-supporting and flexible forearm protector to be worn underneath standard surgical gloves. The invention encompasses the palm and mid- to upper-forearm, with openings at both ends for the forearm and for the thumb and fingers and is comprised of a semi-rigid material that is very flexible and crushable to fit beneath the rubber glove, having at least a very thin cellophane like non-penetrable outer layer and a moisture absorbing inner layer.

DESCRIPTION OF THE PREFERRED EMBODIMENT

Figures 1A, 1B:
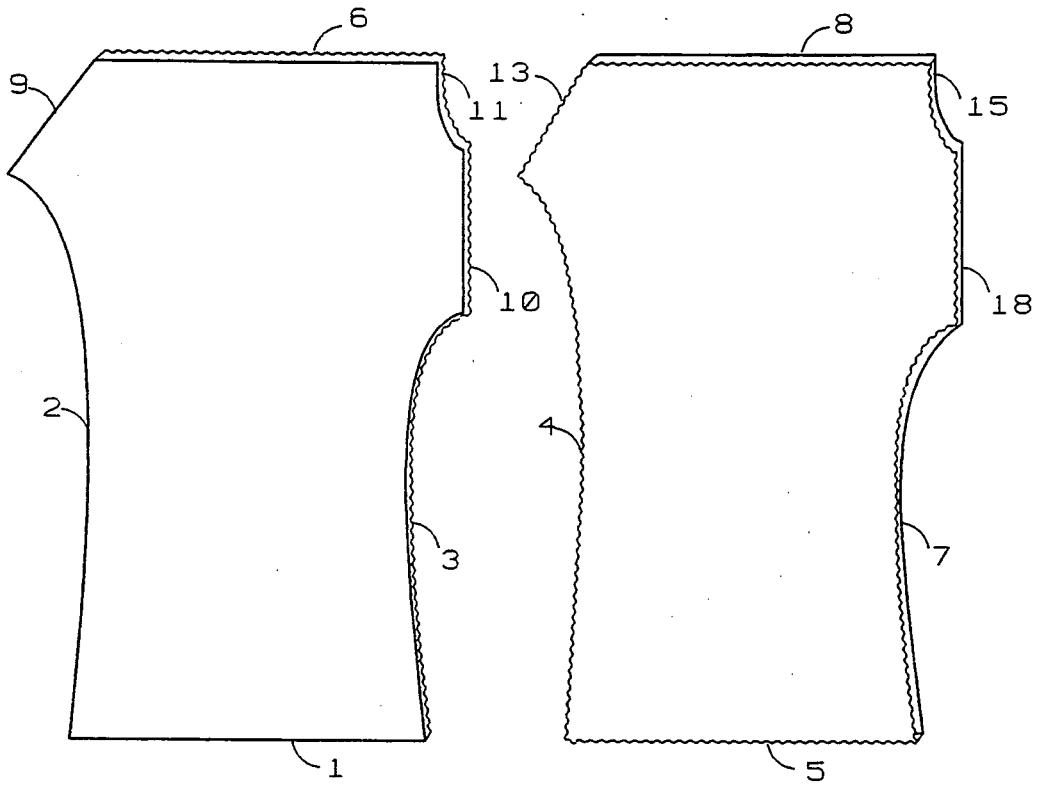
FIG. 1*a* and FIG. 1*b* depict the two pieces of material that will be formed together to create the invention.
Figure 1C:
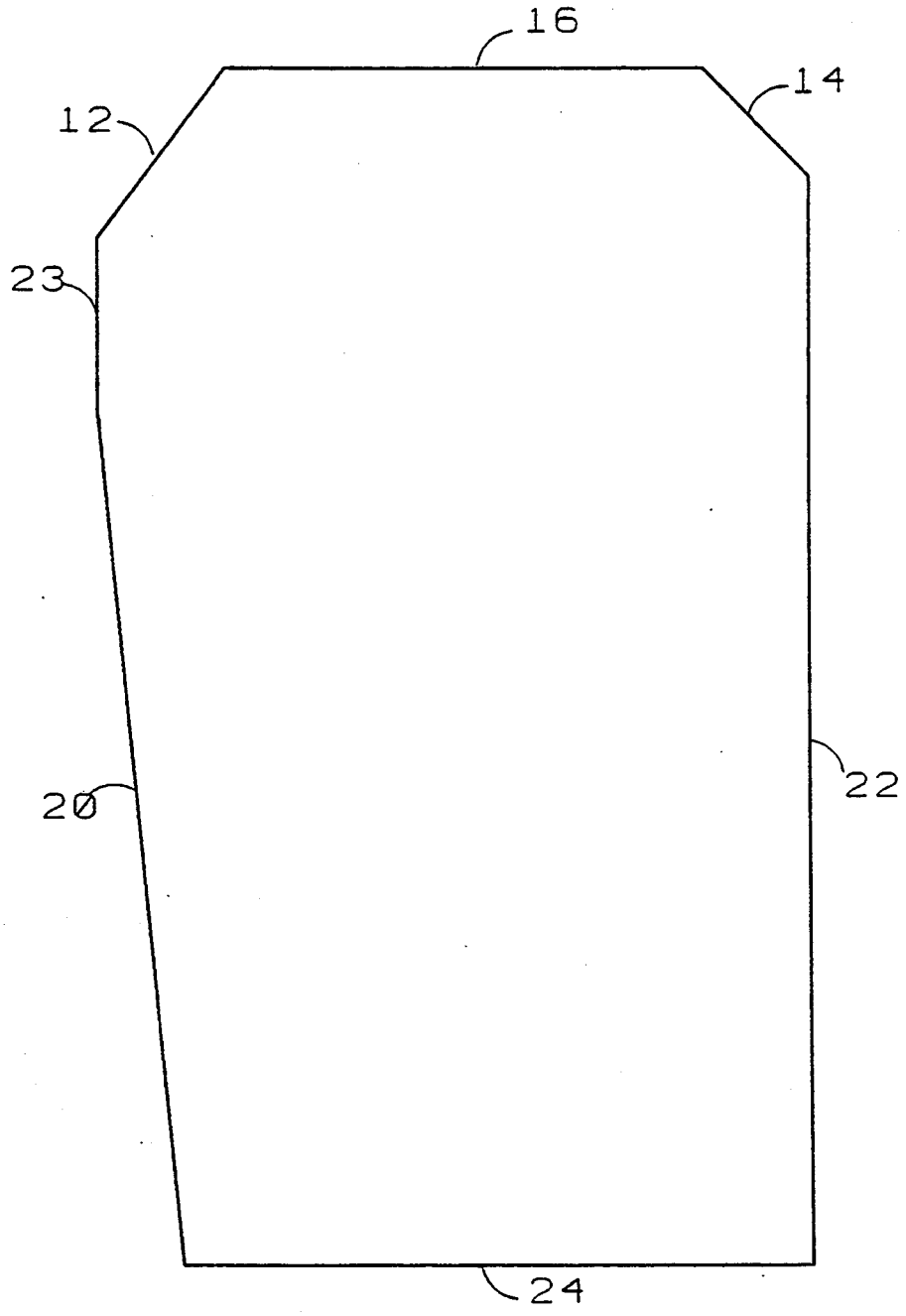
FIG. 1*c* depicts the general shape of the invention in its preferred embodiment.

In the preferred embodiment, the invention is made of two flat substantially symmetric pieces, or halves, of semi-rigid material substantially in the shape 17 and 19 shown in FIG. 1*a* and 1*b*, respectively, except that the ply of materials 1 and 3 is reversed in each figure in the placement on the pattern. Here, "substantially in the shape" refers to the shape in the preferred embodiment and is defined as the elongated shape 25 shown in FIG. 1*c*, tapered from a top end, where the finger holes are located, to the other end and having a corner 14 cut out in the top end for the small finger hole, and a corner 12 cut out opposite said corner 14 at the top end 16. The length of the piece is such that it covers a majority of the adult forearm when in place. The invention includes and would work, with a rectangular shape although, as indicated, the preferred shape is shown as that in Fig 1*a*. Each half is comprised of a thin but light, semi-rigid material that is easily crushable. Easily crushable here refers to the material's ability to crush under the pressure of the rubber surgical gloves so as to fit snugly underneath the rubber glove, yet firm enough to stay up the arm. One side of the material is a moisture absorbing material 3 and 7; the other side is comprised of a cellophane thin and light-weight plastic or polymer type of membrane 1 and 5 material for the prevention of the penetration of nondesirable external fluids and the like. Here light-weight refers to a weight approximately comparable to that of the rubber glove itself. While it can be any weight less than the weight of the rubber glove, it should be no more that two to three ounces in weight. Here semi-rigid refers to a material comparable in rigidity and flexibility to aluminum foil or paper so that the material can be crushable yet support and maintain its position on the forearm as discussed. It is important that the material be crushable and flexible at most, for maintaining the dexterity of the entire fingers, wrist and forearm, and for the purpose of comfort between the fingers. Here, "cellophane thin" or "very thin" is defined as approximately equal to the thickness of cellophane. In the preferred mode, the material consists of at least two membranes of material affixed together one of which is moisture absorbing material, such as soft tissue paper, and the other of which is very thin plastic polymer. They can be pressed together under pressure until they become one semi-rigid material, or they can be glued together. The thin layer of plastic in combination with the moisture absorbing paper attached thereto, provides the sufficient semi-rigidity to be self-supporting, yet inexpensive, flexible and disposable.

Figure 2:
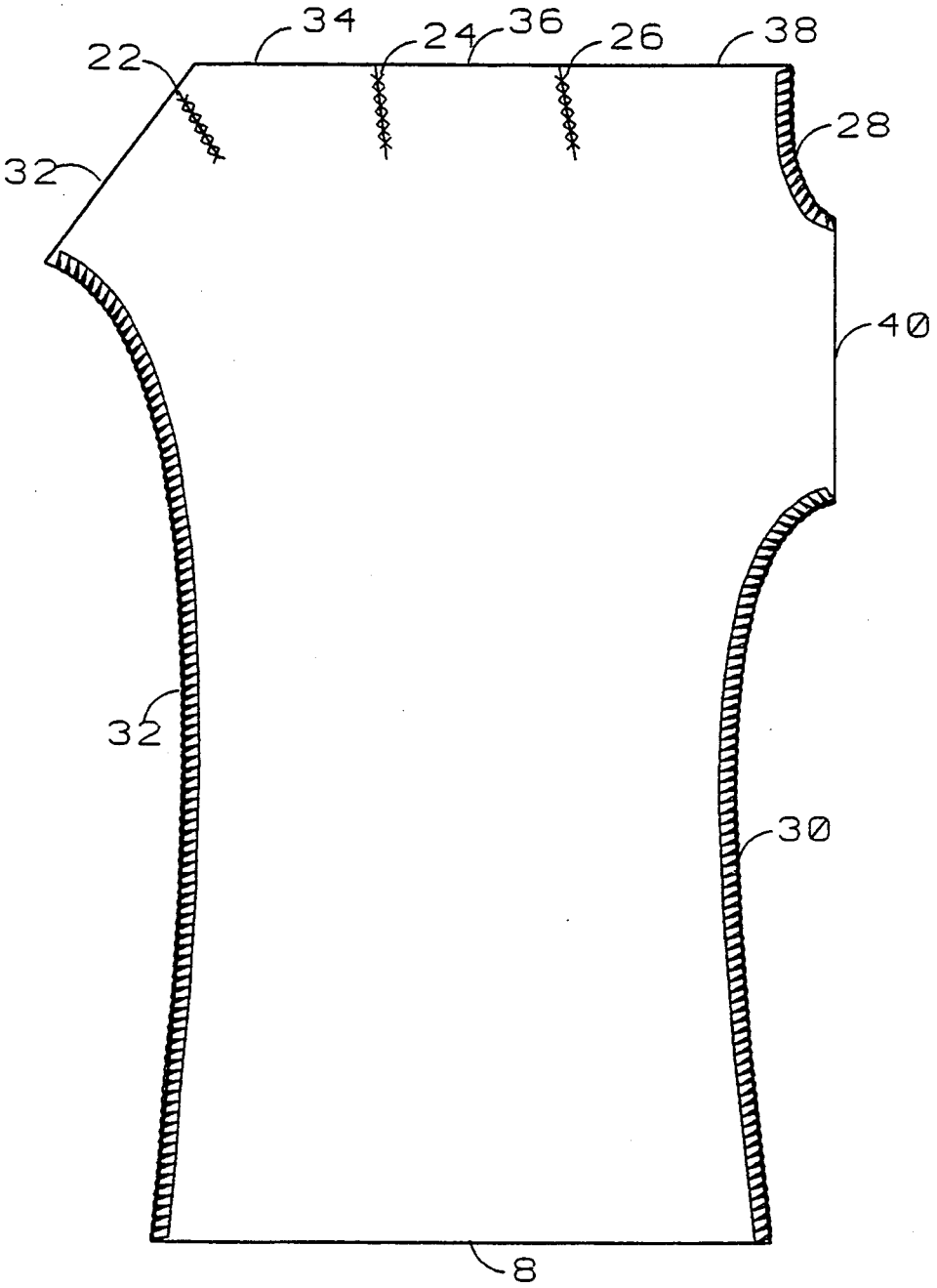
FIG. 2 is a description of the invention, front view, in the preferred embodiment.

The two halves are then placed with moisture absorbing sides 3 and 7 opposing each other and attached together by closure means at 22, 24, 26, 28, 30 and 32 in FIG. 2 leaving finger openings 33, 34, 36, 38 for the pinky, ring, middle and forefingers respectively, a thumb opening 40 and the forearm opening 42. The pinky finger opening 33 is thus an opening having on either side the two edges 9 and 13.

The respective shape, cuts and stitching as discussed in the preferred mode allow for the maximum dexterity once the rubber glove is overlayed on the hand and also allows for the most comfortable wear and easiest placement of the rubber glove over the protector. Stitching means are shown as the closure means; however, any attaching means including glue or heat applied to the plastic is envisioned. Although the invention works with only one or two of the closures 22, 24, 26, or 28, the invention works better with all of them to help protect the movement of the protector up and down the forearm and for more accurate placement of the invention on the hand during use.

Figure 4A:
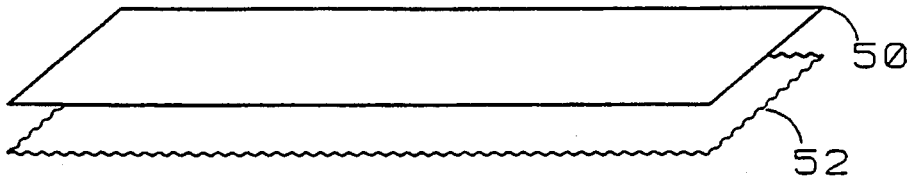
FIG. 4*a* is a side view of the two-ply semi-rigid material.
Figure 4B:
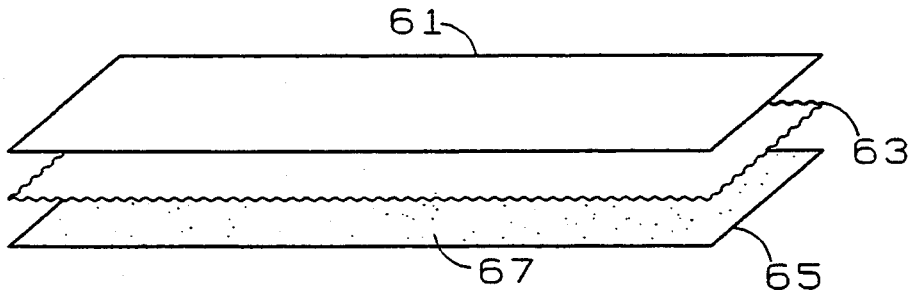
FIG. 4*b* is a side view of the three-ply semi-rigid material.

In an alternative mode of the invention, the semi-rigid material has three (3) membranes or layers of material: very thin plastic or polymer type of material 61, a moisture absorbing material 63 (tissue paper like), and a third material 65 comprised of a paper thin plastic or polymer membrane having minute perforated holes 67 throughout said membrane as shown in FIG. 4*b*. These holes allow for moisture to be absorbed inside to the absorbing layer but the overall membrane together resists its release back towards the skin, to avoid uncomfortability that might be associated with oversoaked protectors during periods of extended use of the invention.

Other combinations of various layers of non-penetrable and moisture absorbent layers may be used, it being of primary significance that the moisture absorbing layer be between the skin and a non-penetrable polymer-like material, and also be sufficiently near the skin to absorb the perspiration. Non-penetrable, as used in this specification and claims to describe the invention does not mean absolutely non-penetrable inasmuch as most materials acceptable for use are not totally non-porous and non-penetrable; moreover, some small, yet acceptable, pinholes may occur at the stitching in the process of attaching the layers of non-penetrable and absorbing materials to each other, and in the process of attaching the two pieces of material together (by stitching or other means) to make the invention. It is principally important that the non-penetrable material prevent most external fluids and the like from reaching the skin in order to be effective. Certainly the more non-penetrable the material is, the more desirable, depending on the cost and use.

Figure 5:
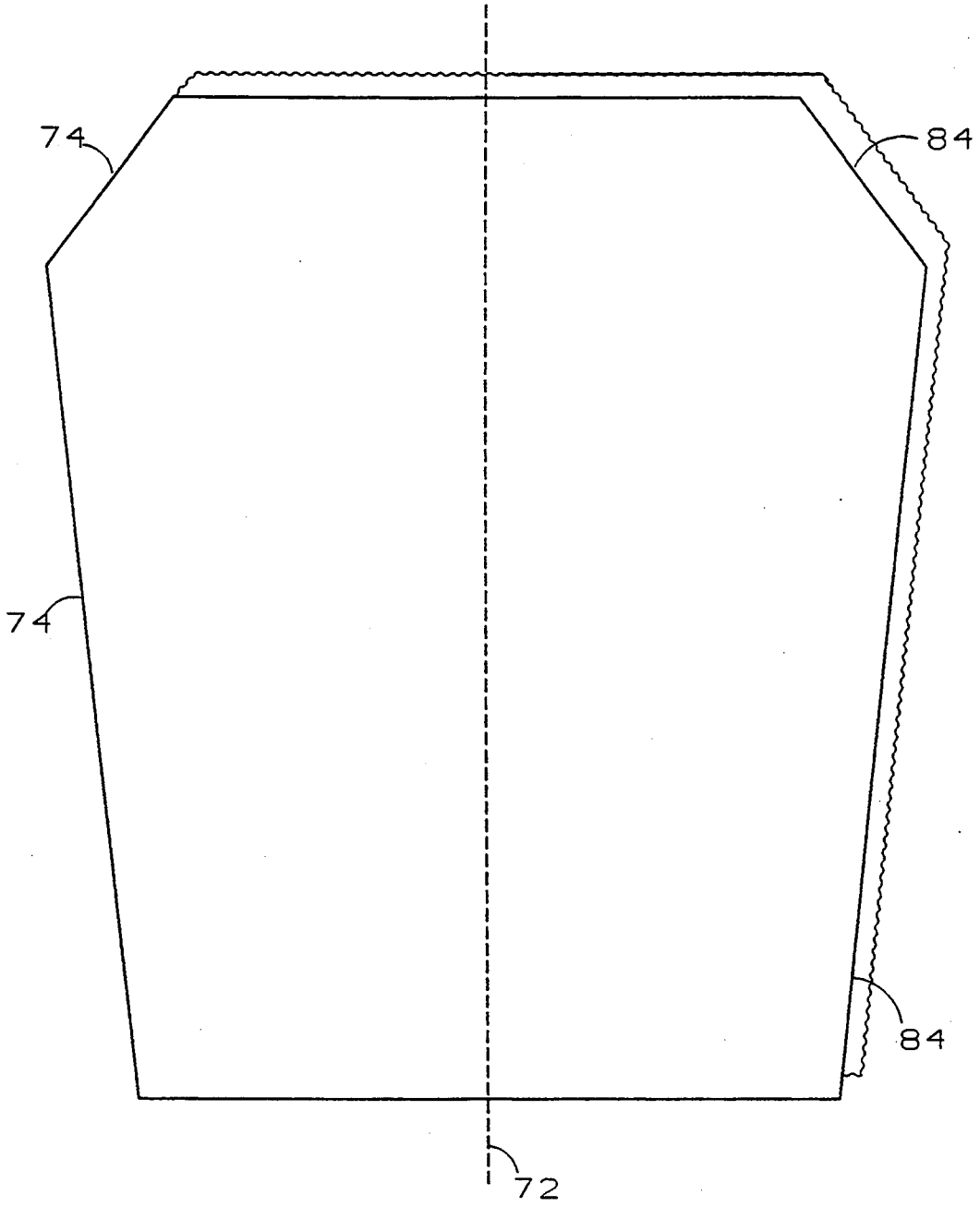
FIG. 5 depicts the invention made out of one piece of the material.

In a still alternative mode of the invention, the invention is formed from one piece 70 in FIG. 5 and folded over at the dotted line 72 representing the approximate axis of symmetry. It is not necessary that the corners at 73 and 75 be cut out as shown and substantially the shape shown includes the shape with or without the said corners. The edges 74 and 84 are connected together as are 73 and 75 with closures along the top 71 made for the finger holes. Thus the edges 77 and 77 create the thumbhole opening as a result of stitch or other closure means at common points 78 and 79. The fold at the axis 72 will avoid the stitching means 32 in FIG. 2., thus reducing cost and increasing the protection from the undesirable fluids or germs.

Consequently, what is disclosed is a forearm protector that appears as an elongated fingerless glove as described, that is loose fitting and can be worn underneath standardly available surgical gloves, that is light, comfortable, moisture absorbing, flexible on the forearm yet sufficiently stiff to remain in place, and inexpensive and disposable as well.

Figure 3:
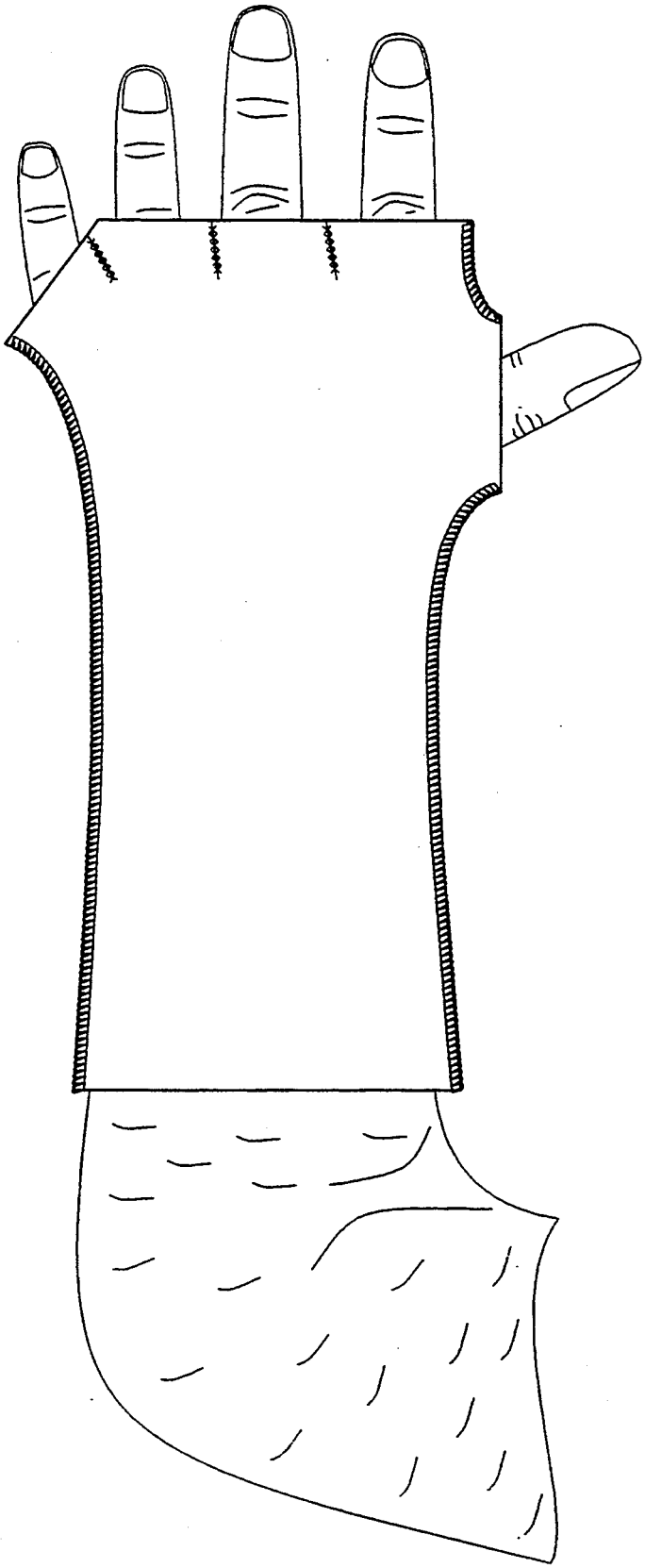
FIG. 3 shows the invention in place on the hand.
Figure 6:
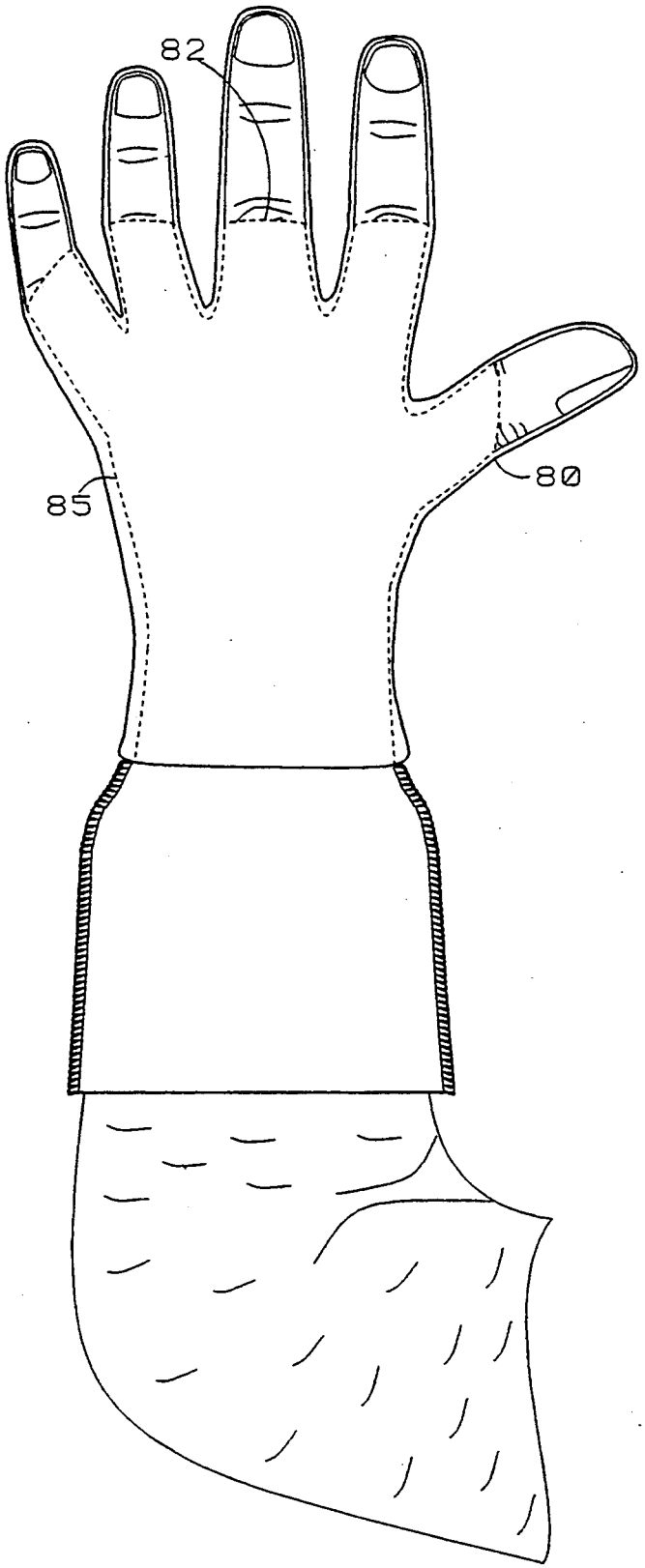
FIG. 6 shows the invention in place on the hand with the rubber glove overlaid in place.

In use, the invention 35 and 87 is placed over the hand and up the forearm as shown in FIG. 3 and FIG. 6 respectively. The standard rubberized surgical glove 80 is then placed over the hand 85 in FIG. 6. The invention is shown by the dotted lines 82 under the rubber glove. These surgical gloves standardly used only approach the wrist portion of the hand. It will be seen then that the invention extends up the forearm, and stays in place, to help prevent foreign fluids and germs from reaching the forearm during surgery or during close contact between patient and doctor. The moisture absorbing material not only absorbs the perspiration that normally accumulates inside when the hand is enclosed in the rubber glove, but also provides comfort in wearing the protector. The light semi-rigidity of the plastic material also provides a slightly light and loose fit around the forearm and a slight air cushion between the palm and the rubber glove to facilitate breathing. It will also be seen that in use, the dexterity of the hand and fingers is maintained.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

I claim:

1. A forearm and skin protector worn over the hand and over the middle to upper forearm of a wearer to be used under rubber surgical type gloves, said protector comprised of two substantially symmetric pieces of semi-rigid material each piece having two opposing sides and two opposing ends, one a finger end and one a forearm end, and having on each side nearest the finger end opposing protruding sections corresponding to a thumb section and a pinkie finger section respectively, and such that when the two pieces are attached together on corresponding sides, an interior is created, and wherein the finger ends of the two pieces are connected so as to create three finger openings in the finger end and substantially opposing thumb and pinkie finger openings on the two sides respectively, and wherein said semi-rigid material is easily crushable, lightweight and has a moisture absorbing side and a non-penetrable to fluids side, and wherein the two pieces of substantially symmetric semi-rigid material are connected so that the absorbing sides of each piece oppose each other to create an interior, and wherein the two pieces are of a size that when connected and worn over the hand and forearm of a wearer the forearm end extends at least to the middle of the forearm of a wearer.

2. A forearm and skin protector worn over the hand and over the middle to upper forearm of a wearer to be used under rubber surgical type gloves, said protector comprised of two substantially symmetric pieces of semi-rigid material said two pieces having corresponding sides and connected together to create two opposing ends, a finger end and a forearm end, and an interior, and attached together on all corresponding sides except at the two ends, wherein the finger end is connected so as to create at least two openings each side having near the finger end a hole, forming substantially opposing thumb and pinkie finger holes, for the remaining fingers, wherein said semi-rigid material is easily crushable, light-weight and has a moisture absorbing side and a non-penetrable to fluid side, and wherein the two pieces of substantially symmetric semi-rigid material are connected so that the absorbing sides of each piece oppose each other to create an interior protector, and wherein the two pieces are of a size that when connected and worn over the hand and forearm of the wearer, the forearm end extends at least to the middle of the forearm of the wearer.

3. A forearm and skin protector worn over the hand and forearm of a wearer to be used under rubber surgical gloves and having an inside nearest the skin of the wearer and an outermost portion opposite thereto, said protector comprised of an easily crushable, lightweight, semi-rigid material forming an enclosure sufficient to enclose the hand and middle to upper forearm of the wearer, having two opposing ends with openings, a forearm end opening and a finger end opening having three holes for fingers, and two sides between the two ends, each side having near the finger end a hole comprising substantially opposing thumb and little finger holes, and wherein said material is comprised of two or more membranes attached together, one membrane of which is a moisture absorbing material, and the other membrane which is a cellophane-thin non-penetrable to fluid polymer material, and whereby the polymer material comprises the outermost portion of the protector.

4. A forearm and skin protector worn over the hand and forearm of a wearer to be used under rubber surgical gloves, said protector comprised of an easily crushable, light-weight, semi-rigid material forming an enclosure sufficient to enclose the hand and middle to upper forearm of the wearer, having two opposing ends with openings, a forearm end opening and at the opposing end an opening for a thumb and four openings, one for each of the remaining four fingers to extrude through when the protector is worn, and wherein said material is comprised of three membranes attached together, one membrane of which is a cellophane-thin non-penetrable to fluid polymer material, the second membrane of which is a cellophane-thin polymer material having minute holes therein for passing fluid through, and the third membrane of which is a moisture absorbing material, wherein said third membrane is sandwiched between the two polymer membranes.

* * * * *